US006130690A

United States Patent [19]

Ahn

[11] Patent Number: 6,130,690

[45] Date of Patent: Oct. 10, 2000

[54] INK JET PRINT HEAD USING MEMBRANE

[75] Inventor: Byung-Sun Ahn, Suwon, Rep. of Korea

[73] Assignee: SamSung Electronics Co., Ltd., Kyungki-do, Rep. of Korea

[21] Appl. No.: 09/291,065

[22] Filed: Apr. 14, 1999

[30] Foreign Application Priority Data

Apr. 14, 1998 [KR] Rep. of Korea ..... 98-13337

[51] Int. Cl.[7] ..... B41J 2/04; B41J 2/05

[52] U.S. Cl. ..... 347/54; 347/63; 347/65

[58] Field of Search ..... 347/54, 56, 61, 347/65, 67

[56] References Cited

U.S. PATENT DOCUMENTS 4,480,259 10/1984 Kruger et al. ..... 347/54
5,652,609 7/1997 Scholler et al. ..... 347/54

*Primary Examiner*—John Barlow
*Assistant Examiner*—Juanita Stephens
*Attorney, Agent, or Firm*—Robert E. Bushnell, Esq.

[57] ABSTRACT

An ink jet print head comprises: a heating unit for heating working liquid provided through a working liquid path depending upon electric energy applied from the outside; and a membrane formed to jet ink provided to an ink supply hole by establishing ratio of at least 2 to 1 of one side to the other side of the membrane so as to have the ratio of the surface area of the membrane to that of the heating unit by an amount equal to at least 2:1.

28 Claims, 7 Drawing Sheets

INK JET PRINT HEAD USING MEMBRANE

CLAIM OF PRIORITY

This application makes reference to, incorporates the same herein, and claims all benefits accruing under 35 U.S.C. §119 from an application for Ink Jet Print Head Using Membrane earlier filed in the Korean Industrial Property Office on Apr. 14, 1998 and there duly assigned Serial No. 13337/1998.

BACKGROUND OF THE INVENTION

1. Technical Field

The present invention relates to an ink jet print head using a membrane and, more particularly, to an ink jet print head capable of setting the lateral size of the membrane to an optimal value.

2. Related Art

Typically, an ink jet print head for use in an ink jet printer has an ink storage drum for storing ink and a working liquid storage part for storing working liquid. A number of heating chambers are provided to circulate the working liquid in a given direction through a heating chamber path.

An explained in more detail below, contemporary ink jet print heads are burdened by several disadvantages: (1) excessive pressure within the ink jet print head in general, and within the heating chamber in particular; (2) small thickness of the membrane layers associated with the heating chambers; (3) slow speed of operation of the ink jet.

SUMMARY OF THE INVENTION

Therefore, an object of the present invention is to provide an ink jet unit having a membrane, a nozzle plate and a heating unit, wherein the amount of transformation of the membrane and the recognition speed are increased through a high-speed jet operation by optimizing the ratio of the lateral dimension of the membrane and the surface area of a resistor and the membrane.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof, as well as in the appended drawings.

To achieve the above object in accordance with the present invention, as embodied and broadly described, the ink jet print head comprises: a heating unit for heating working liquid provided through a working liquid path depending upon electric energy applied from the outside; and a membrane formed to jet ink provided via an ink supply hole. The dimensions of one and another side of the membrane differ by a ratio of at least 2 to 1 in order that the ratio of a surface area of the membrane be larger than that of the heating unit by at least 2 times.

It is to be understood that both the foregoing general description and the following detailed description are exemplary and explanatory, and are intended to provide further explanation of the invention as claimed.

BRIEF DESCRIPTION OF THE DRAWINGS

A more complete appreciation of the invention, and many of the attendant advantages thereof, will be readily apparent as the same become better understood by reference to the following detailed description when considered in conjunction with the accompanying drawings in which like reference symbols indicate the same or similar components, wherein.

DETAILED DESCRIPTION OF THE PREFERRED EMBODIMENTS

Reference will now be made in detail to the preferred embodiment of the present invention, examples of which are illustrated in the accompanying drawings.

Figure 1:
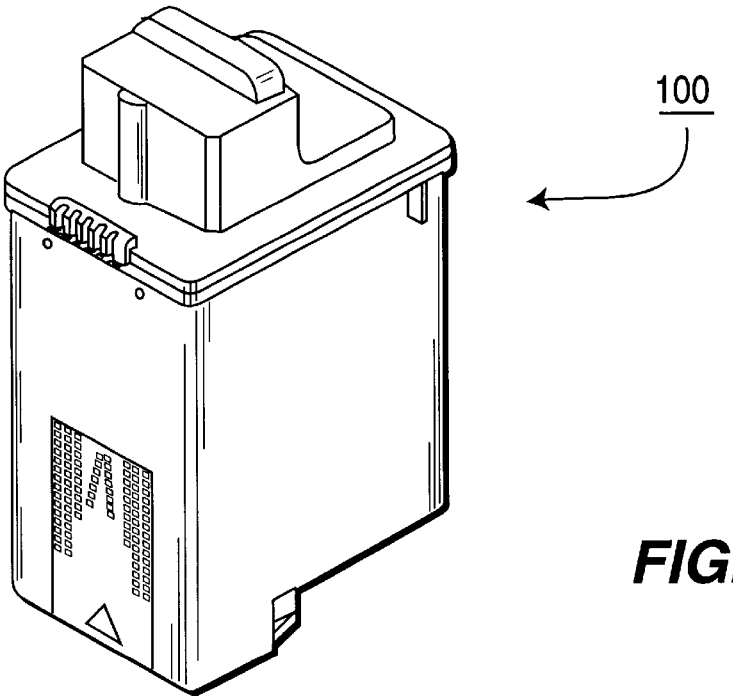
FIG. 1 is a view illustrating an ink jet print head.
Figure 2:
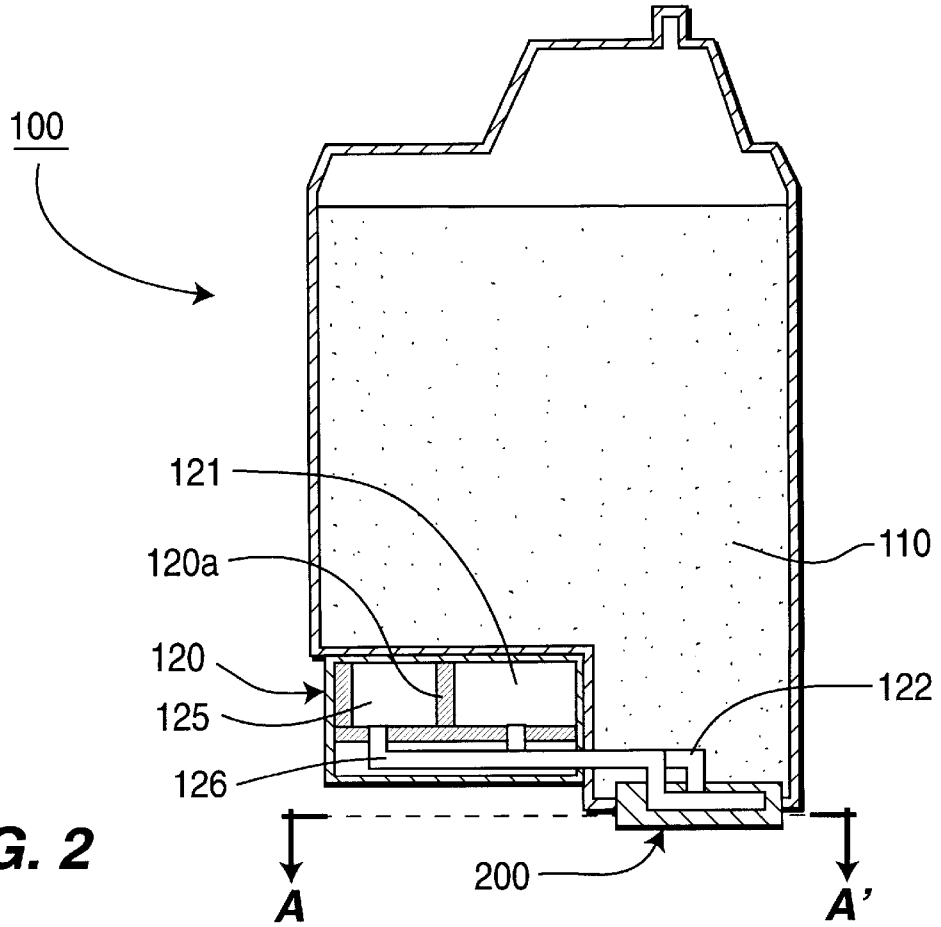
FIG. 2 is a lateral view of the ink jet print head of FIG. 1.

FIG. 1 is a view illustrating an ink jet print head; FIG. 2 is a lateral view of the ink jet print head of FIG. 1.

In general, the ink jet print head 100 to be used in an ink jet printer, as shown in FIGS. 1 and 2, comprises an ink storage drum 110 for storing ink and a working liquid storage part 120 for storing working liquid in the bottom of the ink storage drum 110. The working liquid storage part 120 is divided into a working liquid supply storage part 121 and a working liquid circulation storage part 125 by a division wall 120*a*.

The working liquid stored in the working liquid supply storage part 121 is provided to an ink jet unit 200 through a working liquid main channel 122. The working liquid provided to the ink jet unit 200 is activated by circulation thereof, and is used for jetting the ink. Thereafter, the working liquid is circulated and stored in the working liquid circulation storage part 125 through a working liquid circulation channel 126.

An operation whereby the working liquid activates the ink jet in the ink jet unit 200 will now be described in detail with reference to FIGS. 3–8.

Figure 3:
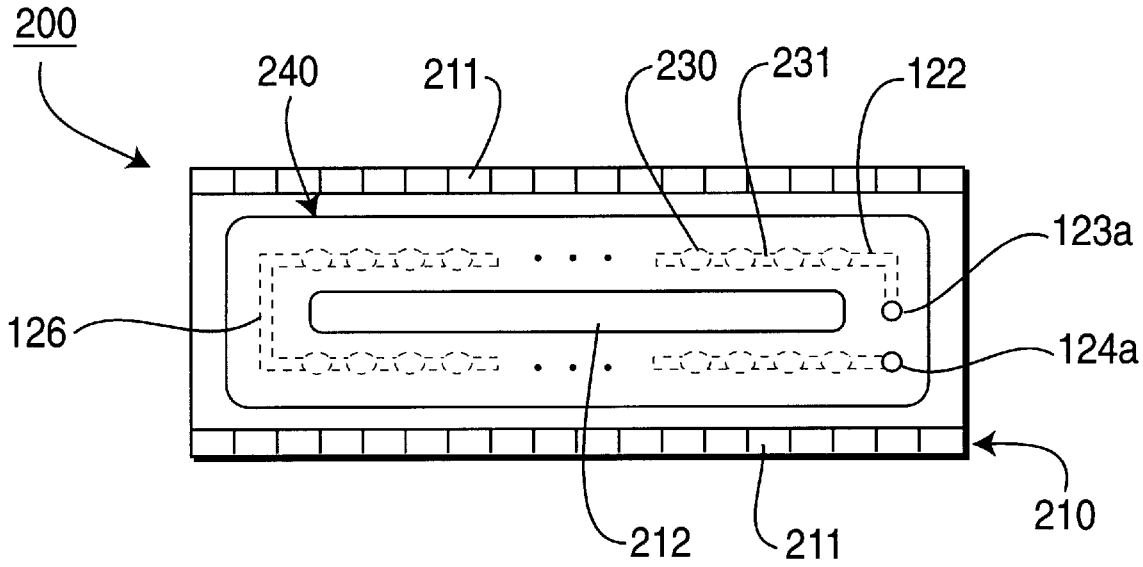
FIGS. 3 and 4 are lateral views along a line A–A' of an ink jet unit of FIG. 2.

First of all, in the internal structure of the ink jet unit 200, as shown in FIG. 3, a plurality of heating chambers 230 are arranged in a substrate 210 by means of a barrier made of polyamide. The heating chambers 230 are connected to circulate the working liquid in one direction through a heating chamber path 231.

When the heating chambers 230 are connected to circulated the working liquid via the heating chamber path 231, the working liquid is provided through the common working liquid supply hole 123*a*, and is circulated through the heating chambers 230. Thereafter, the working liquid is circulated through the working liquid circulation channel 126, and is ejected through the common working liquid circulation hole 124*a*.

Through such circulation, when the heating chambers 230 are temporarily filled with the working liquid, a plurality of heating units (not shown) heat the working liquid, the plurality of heating units being composed of a resistor receiving electric energy which is applied to a plurality of electric terminals 211 formed on the substrate 210. The plurality of electric terminals 211 are provided so as to correspond to the plurality of heating units, and the heating units correspond to the plurality of heating chambers 230.

The working liquid heated by the heating units adds pressure to a membrane layer 240 of the heating chambers 230. The membrane layer 240, when under pressure, expands in the direction of the steam pressure and is then operated so as to be reduced by rapid cooling of the working liquid according to the blocking or cessation of the electric energy applied to the heating unit.

In other words, the internal pressure of each heating chamber 230 is increased by the heat of the working liquid, so that the heat is transferred to the membrane layer 240 sealed by the surface of the heating chamber 230. The membrane layer 240, when heated, expands in dependence upon the direction of the heat to be transferred. Ink provided through the ink supply hole 212 by means of the membrane 240, as expanded by the heat of the surface of the heating chamber 230, is jetted through a nozzle (not shown) of the ink jet unit 200.

When the ink is jetted through the nozzle of the ink jet unit 200, the working liquid is cooled again by blocking the electric energy applied to the heating unit. With the cooling of the working liquid, the membrane 240 expands inside the heating chamber 230 and provides the ink through the ink supply hole 212 so as to perform one cycle of the ink jet unit 200.

Figure 4:
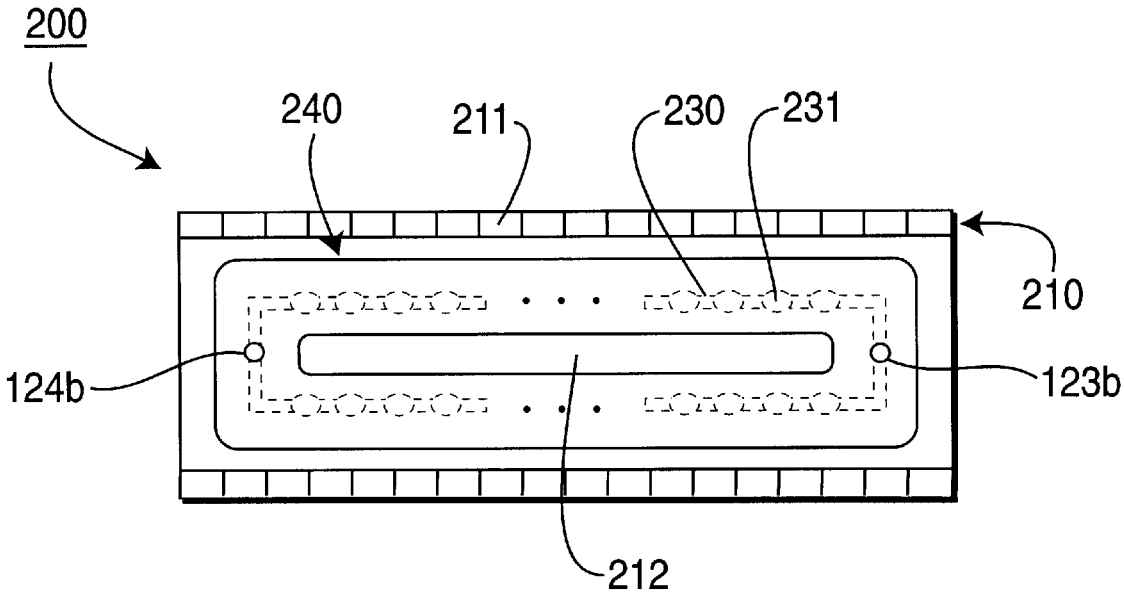

The ink jet unit of another embodiment is shown in FIG. 4. The ink jet unit 200 of FIG. 3 and the ink jet unit 200' of FIG. 4 have almost the same structure and operation. In FIG. 4, the only the common working supply hole 123*b* and the common working circulation hole 124*b* are different from those in FIG. 3. Thus, the explanation of the structure of FIG. 4 will be eliminated.

The size of the membrane layer 240, which is intended to jet ink from the ink jet unit 200, is determined by that of the heating chamber 230. The size of the resistor to be used as a heating unit is the same as or smaller than that of the heating chamber 230. However, the difference there between is very minute, and the membrane layer 240, the heating chamber 230 and the heating unit are almost equally implemented in their sizes.

That is, when the resolution for recognition is 300 dots per inch (hereinafter referred to as "DPI"), the size of the heating unit is 70 μm×75 μm and, when the resolution is 600 DPI, the heating unit size is 42 μm×45 μm. At this point, the heating chamber 230 and the membrane layer 240 have the same size as that of the resistor to be used as the heating unit. As a result, when resolution is changed to 300 DPI and 600 DPI, sizes of the heating chamber 230 and the membrane layer 240 become 70 μm×75 μm and 42 μm×45 μm, respectively.

Figure 5:
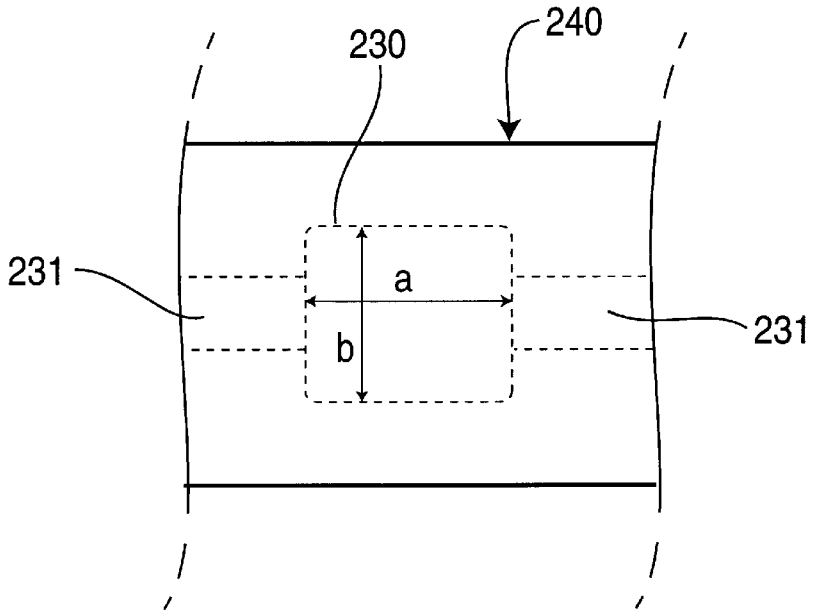
FIG. 5 is an expanded view of a heating chamber of the ink jet unit of FIG. 4.

Thus, the ratio of the length of each side of the membrane layer 240 sealed in the heating unit and the heating chamber 230, as shown in FIG.5, is:

$b/a<1$

In order to determine the characteristics of the membrane layer 240 having the ratio of the length of each side, when the internal pressure of the heating chamber 230 is given as P and the amount of ink jetted through the nozzle is V, the optimal materials Ni, Si, and Polyamide (hereinafter referred to as "PI") of the membrane are as follows:

lateral dimension; a×b=50 μm×50 μm membrane thickness; Ni, Si=0.5–2.5 μm, and PI=1–5 μm, Young's modulus E; Ni=200 Gpa, Si=130 Gpa, and PI=2 Gpa, density α; Ni=8.9*10$^3$ Kg/m$^3$, Si=2.3*10$^3$ Kg/m$^3$, and PI=1.2*10$^3$ Kg/m$^3$, and Poisson coefficient (υ); Ni, Si, and Pi=0.3.

Further, in order to drive the membrane layer 240 in the cases mentioned above, electric energy is applied to the resistor through the electrode terminal 211. The heating unit used as the resistor heats the working liquid provided to the heating chamber 240 by means of the electric energy applied thereto.

When the working liquid is heated, pressure P is generated inside the heating chamber 230. The generated pressure P is used to expand the membrane layer 240, sealed to correspond to the heating chamber 230, which is heated in the membrane layer 240.

At this time, a bow phenomenon $S_0$ occurs in the membrane layer 240, through which the membrane layer 240 is symmetrically deflected from the center thereof. The bow phenomenon, i.e., deflection $S_0$, is disclosed in "Theory of Plate and Shells" by T. S. Timoshenko and S. Woinovsky Krieger (New York, 1959) hereinafter referred to as "reference document (1)".

According to reference document (1), when the size of the membrane layer 240 is $$\frac{b}{a} = 1,$$

$$S_0 = 0.00126\frac{Pa^2}{D}$$

The term P in the above expression indicates pressure in the heating chamber 230, the term a is the length of one side of the membrane layer 240, and the term D is the hardness of the membrane. The hardness of the membrane D is given as:

$$D = \frac{Eh^2}{12} \times \frac{1}{1-\upsilon^2}$$

Where E indicates Young's modulus, h is the thickness of the membrane, and υ is the Poisson coefficient.

Further, in the biharmonic according to the static bows, there is an equation:

$$\Delta\Delta S(x, y) = \frac{P}{D}$$

where the symbols "x" and "y", respectively, indicate the position of any membrane. Then, the two dimensional Laplace operator is given by the equation:

$$\Delta = \frac{\delta^2}{\delta x^2} + \frac{\delta^2}{\delta y^2}$$

Therefore, the relation between the amount of ink jetted and the amount S of transformation of each membrane of the membrane layer 240, under a constant pressure P of the heating chamber 230, is disclosed in reference document (1) and by T. S. Timonoshenko in 1995 by the expression:

$$S=S_0[1-(2x/a)^2]\times[1-(2y/b)^2]$$

Thereby, the amount V of the ink jet jetted by the amount of the transformation of the membrane layer 240 is given by the equation:

$$V=\int\int S(x,y)dxdy.$$

The result becomes:

$$V=\frac{4}{9}S_0ab$$

That is, the amount S of the transformation of the membrane layer 240 and the amount of ink jetted are related by a sector relation.

Such a sector relation is applied when the degree of the deflection $S_0$ of the membrane is smaller than the thickness h of the membrane, i.e., $$S_0 \leq h$$

Moreover, when bending stress of the membrane is considered, the sector relation is also applied.

However, when the variable amount S in consideration of the bending and tension stress of the membrane is considered, reference document (1) provides the following equation:

$$S \approx S_0/[1+0.569(S^2/h^2)]$$

When the above values $$S_0 \approx S,$$

E and V are applied to each of the materials Ni, Si and PI of the membrane, the following are obtained:

Ni: $P=7.0\ (h^3V+0.55hv^3)$,

Si: $P=4.5\ (h^3V+0.55hv^3)$ and

PI: $P=0.07\ (h^3V+0.55hv^3)$.

Figure 6:
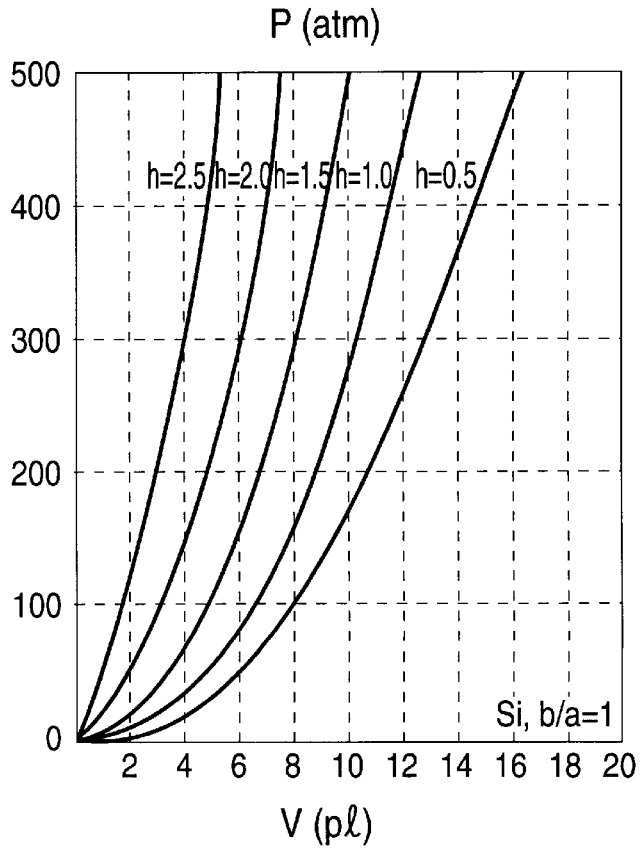
FIGS. 6 to 8 are graphs illustrating characteristics of the membrane of the ink jet unit.
Figure 7:
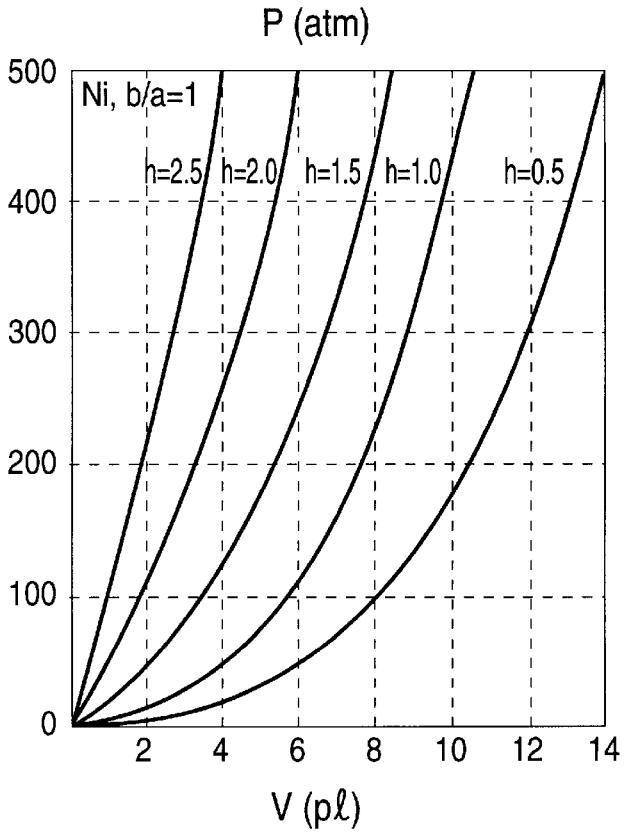
Figure 8:
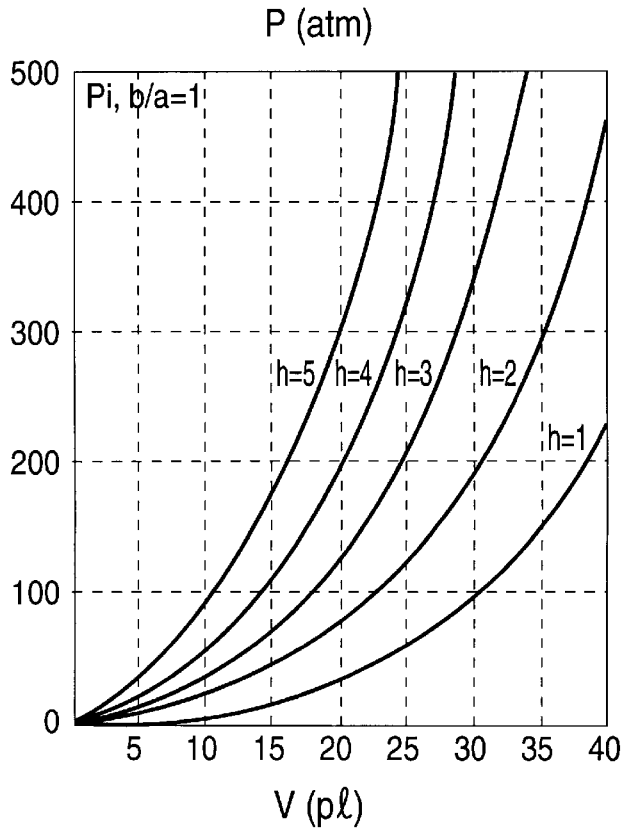

As shown in FIGS. 6, 7 and 8, the above equations have characteristics of a curved tilt. The tilts become different according to the thickness of the materials Ni, Si and PI of the membrane layer 240.

More specifically, the tilt becomes 15–35PI when any letter having resolution of 600DPI is printed by using a mono ink. In such a situation, the driving frequency is over 10KHz, and thus the pressure, as shown in FIG. 6, needs to be 20–50 atmosphere (hereinafter, referred to as "atm").

As a result, there are problems in the ink jet unit described above.

First, the pressure needed for the amount of the ink jet should be very high.

Second, the thickness of the membrane layer 240 needed for the amount of the ink jet is very small.

Third, the speed of the ink jet is very slow because the thickness of the membrane layer 240 becomes thin in proportion to the speed and pressure of the ink jet. The speed of the ink jet is proportional to the pressure by virtue of the following equations $$V-\int_e(areaofnozzle)\int_0^t v(t)\,dt,$$

$$P=\rho_{INK}\left(1-\frac{S^2}{S_M^2}\right)V^2\times\frac{1}{2}=DV^2,$$

where $S_M$ is an area of the membrane and V is the speed of the ink jet.

Figure 9:
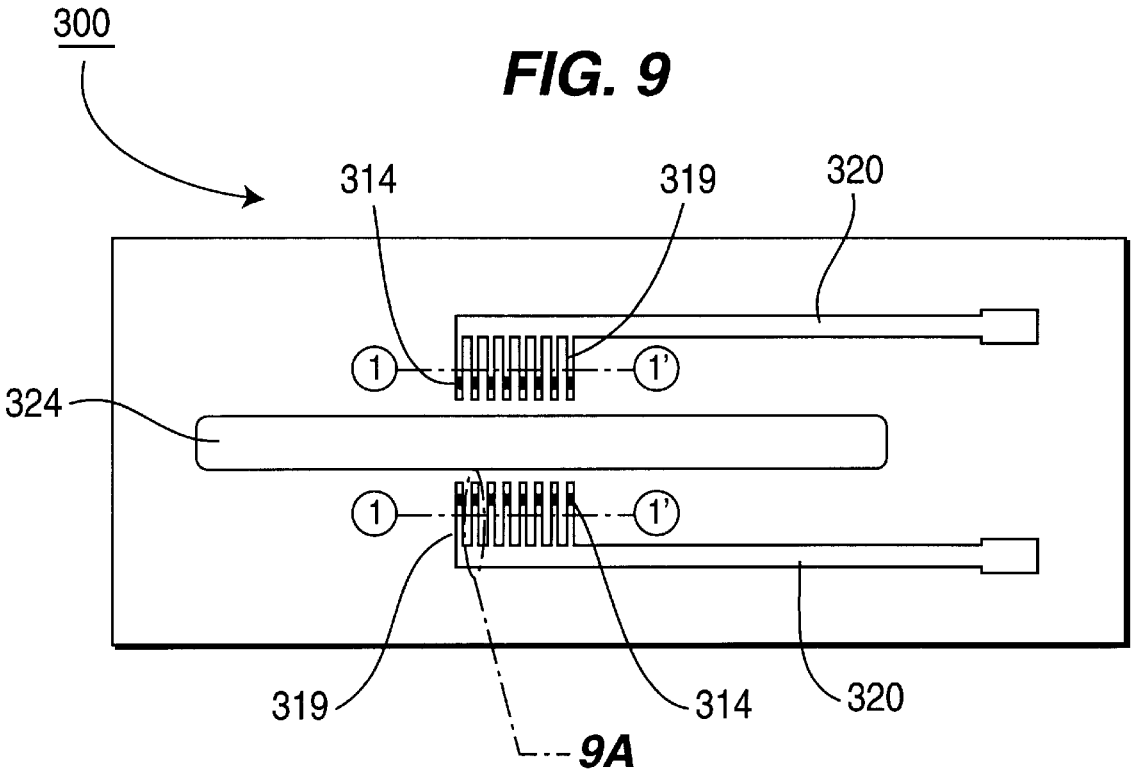
FIGS. 9 and 9A together form a construction view illustrating the membrane and the heating unit of the ink jet unit according to the present invention.
Figure 9A:
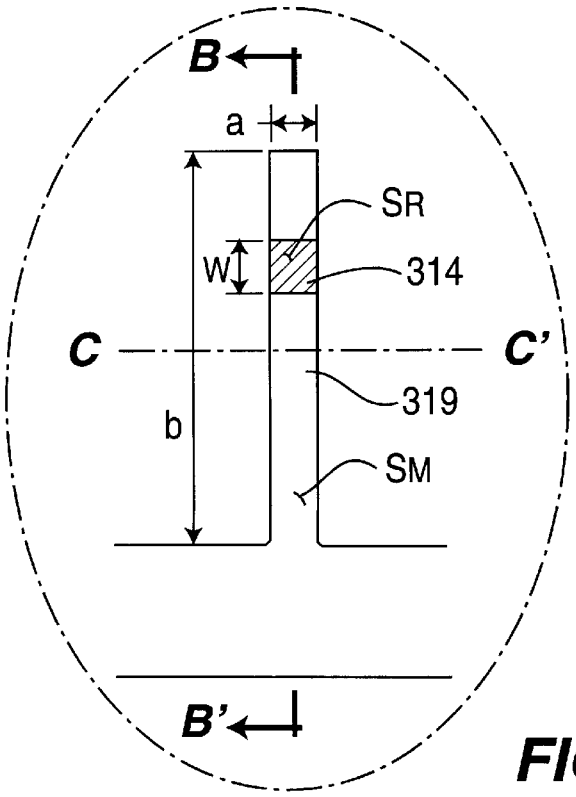

FIGS. 9 and 9A together form a construction view illustrating the membrane and the heating unit of the ink jet unit according to the present invention. In FIGS. 9 and 9A, a heating unit formed by heating part 314 and a membrane 319 are provided. The heating part 314 heats the working liquid provided through a working liquid path 320 depending upon electric energy applied from outside. The heating part 314 is preferably embodied by a resistor. The membrane 319 is employed to jet ink provided from an ink supply hole 324 according to pressure of the working liquid by making the length b of one side larger than the length a of the other side by at least 2 times so that the surface area $S_M$ of membrane 319 is larger than the surface area $S_R$ of the heating part 314 by at least a ratio of 2 to 1.

The ratio of the surface area $S_R$ of the heating part 314 to the surface area $S_M$ of the membrane 319 is:

$$\frac{S_R}{S_M}=1/2\ \text{to}\ 1/8.$$

The optimal condition is:

$$\frac{S_R}{S_M}=1/3\ \text{to}\ 1/5.$$

The surface area $S_M$ of the membrane 319 constitutes an area of an operating part of the membrane 319 (i.e. an effective area transformed by the pressure of the working liquid).

In the above membrane 319, the ratio of one side b to the other side a (which is the lateral dimension) has to meet the following equation:

$$\frac{b}{a}=1.5\ \text{to}\ 8.$$

The heating part 314 is located on one side of a line C–C' which passes through the center of one side b of the operating part of the membrane 319, and the heating part 314 is centered on another line B–B' passing through the center of the other side a of the membrane 319.

In the present invention, an embodiment having $$\frac{b}{a}\approx 5$$

as a condition of the lateral size of the membrane 319 will be explained hereinafter.

First of all, the working liquid provided through the working liquid path 320 is heated by the heating part 314 which generates heat through electric energy. As a result, the heated working liquid generates pressure P in an ink chamber (not shown) formed on the heating part 314.

The membrane 319 is heat-expanded by the pressure P in the heating part 314 and the heat of the working liquid, and is then deflected. At this point, the membrane 319 is deflected in the direction of the surface thereof and is also deflected in the direction of the ink chamber (not shown) for storing ink provided through the ink supply hole 324. The degree of the deflection is shown as $S_{01}$, which means a static deflection.

Thus, according to the reference document (1), the static deflection $S_{01}$ is expressed as:

$$S_{01} = 0.0026\frac{Pl^4}{D}.$$

The amount S of real displacement is given by the equation $$S=S_{01}/[1+0.788(S^2/h^2)].$$

If the relation between the static deflection $S_{01}$ and the amount S of real displacement is given as $$S_{01}\approx S,$$

the amount V of ink jet is expressed as $$V \approx \frac{4}{9} \times Sab$$

Further, the materials Ni, Si and PI of the membrane are expressed as follows:

Ni: $P=0.68\ (h^3V+0.0028hv^3)$

Si: $P=0.44\ (h^3V+0.0028hv^3)$

PI: $P=0.0068\ (h^3V+0.0028hv^3)$.

Figure 10:
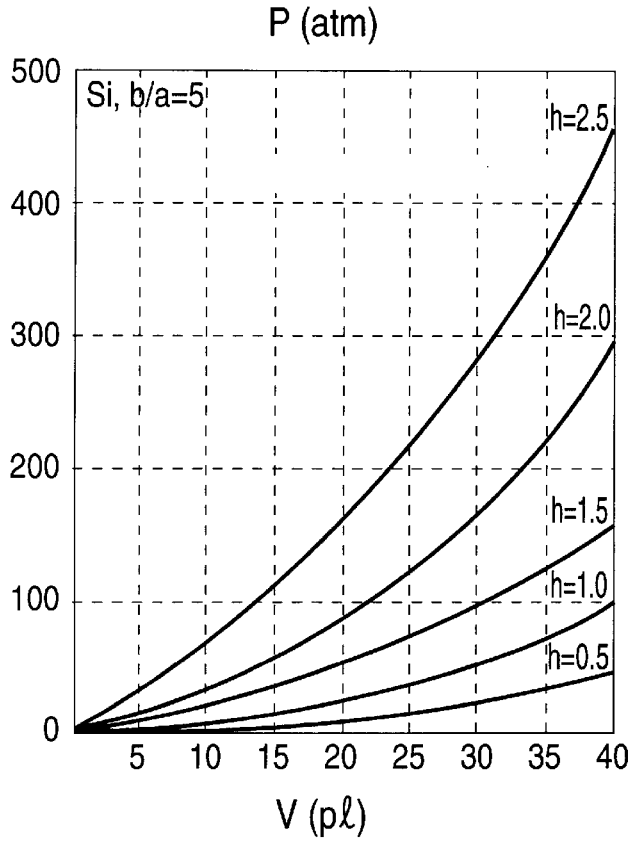
FIGS. 10 to 12 are graphs illustrating characteristics of the membrane of the ink jet unit according to the present invention.
Figure 11:
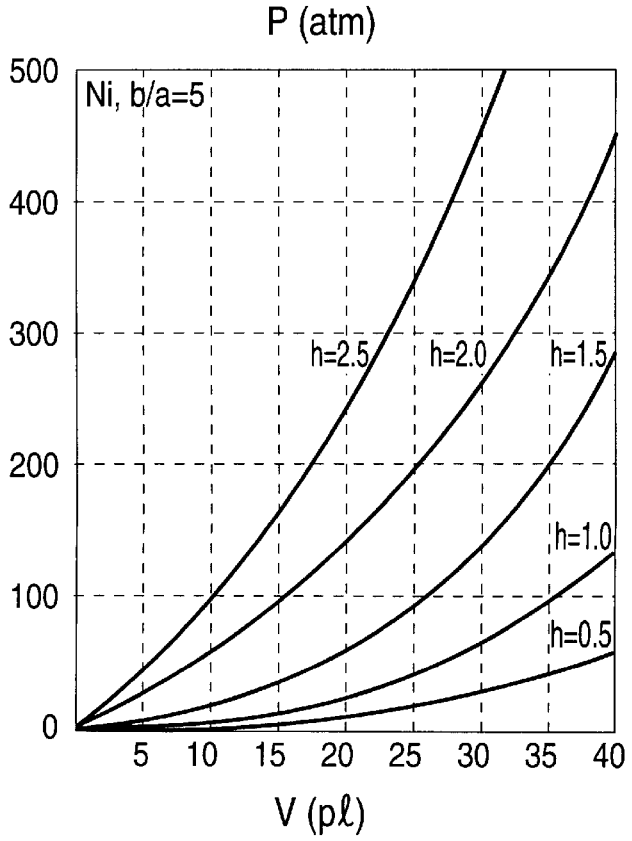
Figure 12:
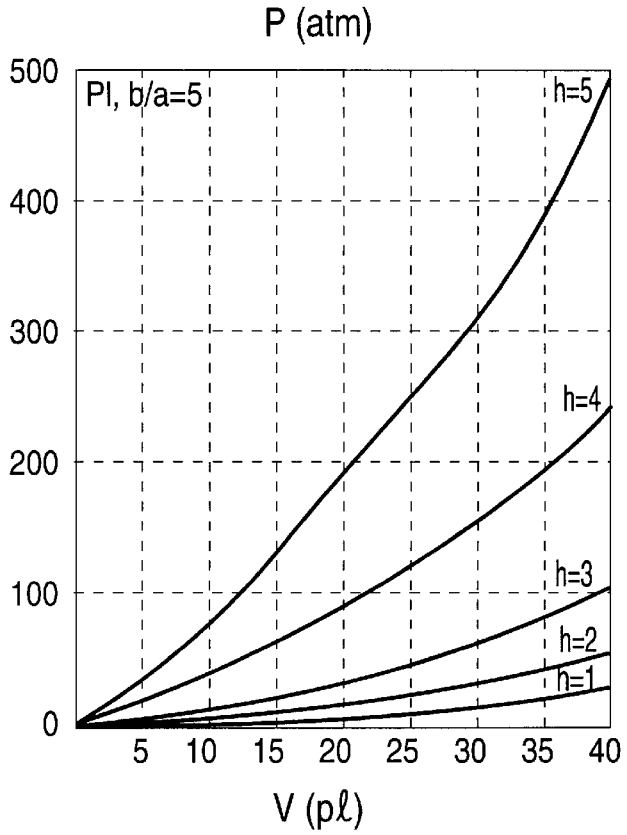

When the pressure P and the amount V of the ink jet are shown as the above, according to the material of the membrane 319, the results shown in FIGS. 10 to 12 will be obtained.

When the resolution is 600DPI in the graph illustrating the pressure P and the amount V of the ink jet, the needed amount of the ink jet and the pressure should be V=15 to 35 pl and P=20 to 50 atm, respectively. As shown in FIGS. 10 to 12, in the case of Ni, such pressure and the amount of ink jet can be satisfied even when the thickness of the membrane 319 is 1.5 $\mu$m. In the case of PI, the pressure and amount of ink jet can be satisfied even when the thickness of the membrane is 5 $\mu$m.

With respect to the relation between the pressure P, the amount V of the ink jet, and the thickness of the membrane 319, if the resolution is 600 DPI, the pulse depending upon the electric energy applied to the heating part will be explained hereinafter.

First of all, the pressure P and the amount V of the ink jet can be expressed as a function of time by $BV(t)+CV^3(t)=P(t)-P_{INK}(t)$, where B and C are coefficients to be determined by the membrane 319, P(t) is the pressure in the heating part 314, and $P_{INK}(t)$ is pressure in the ink chamber.

In the meantime, the relation between the nozzle (not shown) of the ink jet unit and the ink chamber is expressed by a Bernuolli theory as $P_{INK}=P_{INK}\ (1-S_C^2/S_M^2)\ V^2=DV^2$, where V is the speed of the ink jet, $S_C$ is the area of the nozzle, and $S_M$ is the area of the membrane 319.

Further, the relation between the amount V of the ink and the area $S_C$ of the nozzle can be given as $$V=S_C\int_0^t V(t)dt.$$

If the $V^3$ is not regarded because the amount V of the ink jet is very minute, and if P(t)=Kt (in the present invention, the value of K is 19), the relation therebetween is given as:

$$B'v = \frac{dp}{dt} - 2Dv\frac{dv}{dt}.$$

Also, the optimal speed $V_{MAX}$ of the ink jet for the maximum pressure is expressed as $$V_{MAX} = \frac{1}{B'}\frac{dp}{dt} = \frac{19}{B'}$$

because of $$\frac{dp_{INK}}{dt} = \frac{dv}{dt}.$$

In this case, B' is equal to $BS_C$ and K is 19. In addition, if the equation $$B'v = \frac{dp}{dt} - 2Dv\frac{dv}{dt}$$

is integrated over time t, the following equation is obtained:

$$dt=2Dv/(19-B'v)dv.$$

This equation can be differently expressed, as:

$$t = -38\frac{D}{B^2}\left[\ln\left(1-\frac{V}{V_{MAX}}\right)+\frac{V}{V_{MAX}}\right].$$

This equation can show the relation between the pulse time of the electric energy and the speed V of the ink jet.

In other words, when the ratio of the lateral size of the membrane 319 is:

$$\frac{b}{a} \approx 1,$$

and, when the thickness of the membrane 319 is 1.3 $\mu$m when the materials Ni and Si are used, the speed of the ink jet becomes 4 m/sec. Further, in the case of the material PI, the speed of the ink jet of the membrane 319 is 15–20 m/sec.

On the other hand, if the ratio of the lateral size of the membrane 319 is $$\frac{b}{a} \approx 5,$$

the thickness of the membrane 319, when made of the materials Ni and Si, is 1.3 and the speed of the ink jet is approximately 19–30 m/sec. Further, when the membrane is of the material PI, the speed of the ink jet is 150–200 m/sec.

Thus, with respect to the ratio for the relation between the real jet speed V and the pulse time T and the maximum jet speed $V_{MAX}$, it is known that $V/V_{MAX}$=0.4–0.5, particularly when the material of the membrane 319 is Si or Ni; when the thickness of the membrane is 1, the ratio is given as 0.7–0.9.

In conclusion, the following table can be made:

(TABLE)

| | Si, Ni (h = 1 $\mu$m, t = 1 $\mu$s) | | PI (h = 3 $\mu$m, t = 1 $\mu$s) | |
|---|---|---|---|---|
| | b/a = 1 | b/a = 5 | b/a = 1 | b/a = 5 |
| The maximum speed | approximately 10 m/sec. | approximately 10 m/sec. | 15 m/sec. | 150 m/sec. |

(TABLE)-continued

| | Si, Ni (h = 1 μm, t = 1 μs) | | PI (h = 3 μm, t = 1 μs) | |
|---|---|---|---|---|
| | b/a = 1 | b/a = 5 | b/a = 1 | b/a = 5 |
| ($V_{MAX}$) in theory | | | | |
| $V/V_{MAX}$ | 0.7–0.9 | 0.7–0.9 | | 0.38 |
| Real Speed (V) | 7~9 m/sec. | 28~36 m/sec. | | 57 m/sec. |

Thus, when print resolution, driving frequency and thickness are given as 600DPI, 12 $KH_Z$, and 1–1.3 μm, respectively, if the material of the membrane is PI, it is well known that the optimal case is given as h-3 μm and b/a=5 as so to maintain the time needed in the ink jet and the speed of the ink at 20 m/sec, and to have a number of operations up to $3\times10^7$.

Figure 13:
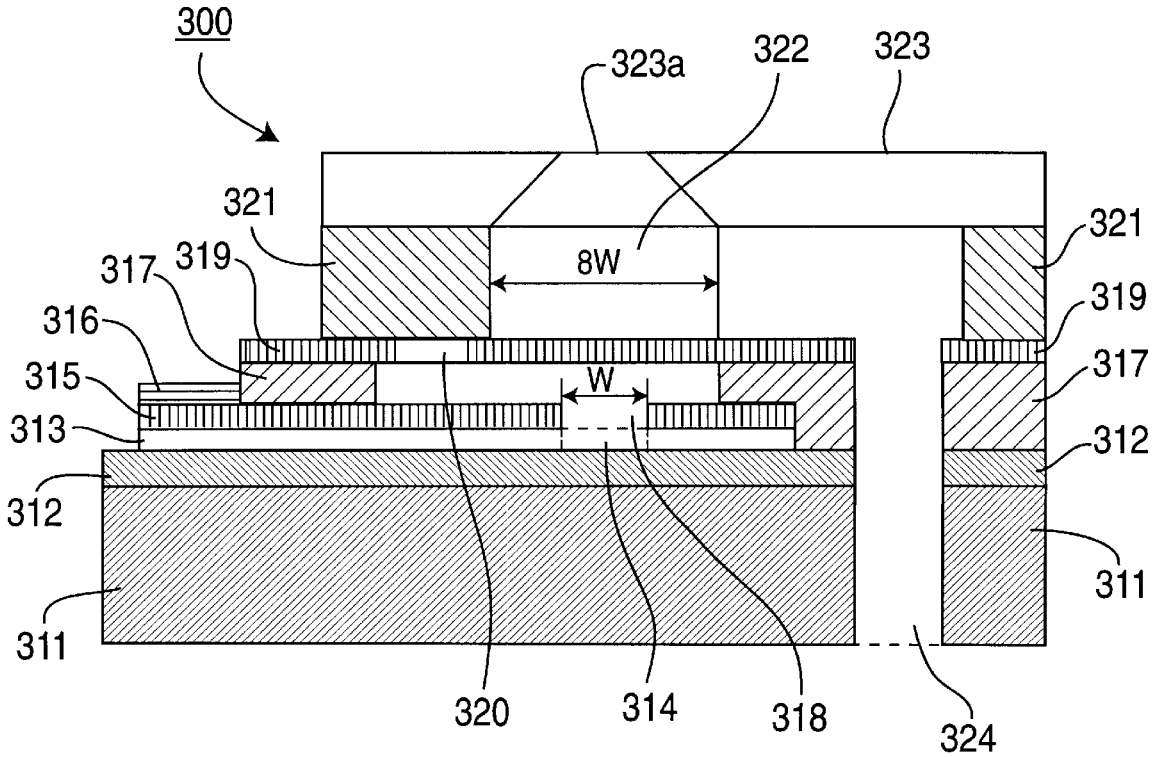
FIG. 13 is a view of the construction of a main part an embodiment of the ink jet unit employing a membrane and a heating unit according to the present invention.

Referring to FIG. 13, an embodiment of the ink jet unit when using a membrane 319 having the optimal case will be explained.

In FIG. 13, the ink jet unit 300 has a register layer 313 to form the heating unit 314 in a thermal barrier 312 which is formed on the substrate 311. The heating unit 314 is provided with electric energy through a conductive layer 315 formed in the thermal barrier 312, the electric energy being supplied from the outside through the electrode terminal 316.

The working liquid, provided through the working liquid supply hole 320, is temporarily stored in the conductive layer 315. Also, a heating chamber barrier 317 is formed in the conductive layer 315 to provide a heating chamber 318 having width W. Further, in order to cause deflection in the membrane 319 by pressure generated by the working liquid stored in the heating chamber 318, the membrane 319 (whose width should be larger than the width W of the heating chamber 318 by 1.5–8 times) is formed on the heating chamber barrier 317.

At this point, since the width W of the heating chamber 318 is the same as that of the heating unit 314 having a lateral size, it can be determined that the width of the membrane 319 is larger, by 1.5–8 times, than one side of the lateral size of the heating unit 314. This is intended to satisfy the ratio of the lateral size of the membrane 319 being larger than a side of the heating unit 314. Further, if the material of the membrane 319 is made of polymide, the thickness of the membrane 319 is in the range of 1–4 μm, and its optimal thickness is in the range of 2–3.5 μm.

Therefore, ink chamber 322 is formed on membrane 319 for storing ink provided from the ink supply hole 324, the ink chamber barrier 321 being formed on membrane 319. The ink chamber 322 stores the ink jetted by pressure of the working liquid and the deflection of the membrane 319.

The path along which ink inside the ink chamber 322 is jetted is intended to jet the ink on the ink chamber barrier 321 through the nozzle 323*a*, thereby performing the print operation. The nozzle 323*a* is formed in the nozzle plate 323.

Accordingly, in the present invention, the following efficiencies are provided.

First, it is possible to calculate the needed amount of the ink jet by measuring the amount of transformation of the membrane under use of low energy.

Second, the thickness of the material I of the membrane can be as much as 5 μm so as to obtain reliability by increasing the life of the membrane.

Third, it is possible to increase the speed of the print operation because of the possibility of the high-speed jet, even though there exists, in theory, an internal loss due to the maximum speed of the jet.

It will be apparent to those skilled in the art that various modifications and variations can be made in the ink jet print head of the present invention without departing form the spirit or scope of the invention. Thus, it is intended that the present invention cover the modifications and variations of this invention provided they come within the scope of the appended claims and their equivalents.

What is claimed is:

1. An ink jet print head, comprising:

a heating chamber for receiving working liquid directed through a working liquid path;

a membrane forming a side of said heating chamber and having first and second adjacent sides, wherein a length of said first side is at least twice a length of said second side in order that a surface area of said membrane is at least two times larger than a surface area of said heating unit; and a heating unit disposed adjacent to said heating chamber for heating the working liquid received in said heating chamber;

wherein said heating unit is disposed on one side of an imaginary center line passing through a center of said first side of said membrane.

2. The ink jet print head as claimed in claim 1, wherein a ratio of said surface area $S_R$ of said heating unit to said surface area $S_M$ of said membrane is in a range of ⅛ to ½.

3. The ink jet print head as claimed in claim 2, wherein an optimal value of said ratio is in a range of ⅕ to ⅓.

4. The ink jet print head as claimed in claim 1, wherein a ratio of said first side to said second side is optimally in a range of 2:1 to 5:1.

5. The ink jet print head as claimed in claim 1, wherein said membrane is made of polyamide.

6. The ink jet print head as claimed in claim 5, wherein a thickness of said polyamide is in a range of 1–4 μm.

7. The ink jet print head as claimed in claim 1, wherein said heating unit is disposed and centered on a further imaginary line passing through a center of said second side of said membrane.

8. An ink jet print head, comprising:

a thermal barrier;

a conductive layer for applying electric energy provided from an outside source through an electrode terminal to a heating unit, said conductive layer being formed on said thermal barrier;

a heating chamber barrier having a heating chamber of given width for temporarily storing working liquid, said heating chamber barrier being formed on said conductive layer;

a membrane having a width larger than a width of said heating chamber by a factor in a range of 5:1 to 8:1, and formed on said heating chamber barrier in order to make a deflection therein as a result of pressure generated by heat of said working liquid temporarily stored in said heating chamber;

an ink chamber barrier formed on said membrane and surrounding an ink chamber for storing ink; and a nozzle plate for forming a nozzle to jet said ink stored in said ink chamber by means of said deflection of said membrane.

9. The ink jet print head as claimed in claim 8, wherein said membrane is made of polyamide.

10. The ink jet print head as claimed in claim 9, wherein a thickness of said polyamide is in a range of 1–4 μm.

11. The ink jet print head as claimed in claim 8, wherein said membrane has first and second adjacent sides, said first side being larger than said second side, and wherein said heating unit is disposed on one side of an imaginary line passing through a center of said first side of said membrane.

12. The ink jet print head as claimed in claim 11, wherein said heating unit is disposed and centered on a further imaginary line passing through a center of said second side of said membrane.

13. An ink jet print head, comprising:

a heating chamber for receiving working liquid provided through a working liquid path;

a membrane forming a side of said heating chamber and formed to jet ink provided to said ink jet print head; and a heating unit disposed adjacent to said heating chamber for heating the working liquid received in said heating chamber so as to deflect said membrane and to jet said ink; and wherein a surface area of said membrane is two to eight times a surface area of said heating unit.

14. The ink jet print head as claimed in claim 13, wherein the surface area of said membrane is three to five times the surface area of said heating unit.

15. The ink jet print head as claimed in claim 13, wherein said membrane is made of polyamide.

16. The ink jet print head as claimed in claim 15, wherein a thickness of said polyamide is in a range of 1–4 μm.

17. The ink jet print head as claimed in claim 13, wherein said membrane has first and second adjacent sides, said first side being larger than said second side, and wherein said heating unit is disposed on one side of an imaginary line passing through a center of said first side of said membrane.

18. The ink jet print head as claimed in claim 17, wherein said heating unit is disposed and centered on a further imaginary line passing through a center of said second side of said membrane.

19. An ink jet print head, comprising:

a thermal barrier formed on a substrate;

a heating unit disposed above said thermal barrier;

a conductive layer disposed above said thermal barrier for applying electric energy to said heating unit;

a heating chamber barrier formed on said conductive layer and including a heating chamber for temporarily storing working liquid;

a membrane formed on said heating chamber barrier and adapted to deflect as a result of pressure generated by a heat of said working liquid temporarily stored in said heating chamber;

an ink chamber barrier including an ink chamber disposed above said membrane for storing ink; and a nozzle plate disposed above said ink chamber barrier and having an opening forming a nozzle to jet said ink stored in said ink chamber due to deflection of said membrane.

20. The ink jet print head as claimed in claim 19, wherein said membrane is made of polyamide.

21. The ink jet print head as claimed in claim 20, wherein a thickness of said polyamide is in a range of 1–4 μm.

22. The ink jet print head as claimed in claim 21, wherein a thickness of said polyamide is optimally in a range of 2–3 μm.

23. The ink jet print head as claimed in claim 19, further comprising a resistive layer disposed between said thermal barrier and said conductive layer.

24. The ink jet print head as claimed in claim 19, wherein said heating chamber has a width W, and said ink chamber has a width larger than W.

25. The ink jet print head as claimed in claim 19, wherein said membrane has a width which is larger than a width of said heating unit by at least two times.

26. The ink jet print head as claimed in claim 25, wherein the width of said membrane is two to five times larger than the width of said heating unit.

27. The ink jet print head as claimed in claim 19, wherein said membrane has a surface area which is at least two time larger than a surface area of said heating unit.

28. The ink jet print head as claimed in claim 27, wherein the surface area of said membrane is two to eight times larger than the surface area of said heating unit.

* * * * *